United States Patent [19]

Brown

[11] Patent Number: 4,586,675

[45] Date of Patent: May 6, 1986

[54] TANGLE FREE CORD HOLDER

[76] Inventor: Robert L. Brown, 322 Davis Dr., Kingston, Tenn. 37763

[21] Appl. No.: 641,265

[22] Filed: Aug. 16, 1984

[51] Int. Cl.[4] ..... B65H 75/40

[52] U.S. Cl. ..... 242/85.1; 242/96

[58] Field of Search ..... 242/85.1, 96; 24/129 R, 24/129 A, 129 B, 130, 132 R, 132 AA, 132 WL

[56] References Cited

U.S. PATENT DOCUMENTS

| | | | |
|---|---|---|---|
| 1,280,393 | 10/1918 | Cannon | 24/129 A |
| 1,728,106 | 9/1929 | Collins | 242/85.1 |
| 2,048,300 | 7/1936 | Showers | 24/130 |
| 2,470,658 | 5/1949 | Simpson | 242/85.1 |
| 3,612,426 | 10/1971 | Germock, Jr. | 242/85.1 |
| 3,626,495 | 12/1971 | Bastian, Jr. | 242/85.1 |
| 4,261,529 | 4/1981 | Sandberg et al. | 242/85.1 |
| 4,277,035 | 7/1981 | Gaski | 242/85.1 |

FOREIGN PATENT DOCUMENTS

| | | | |
|---|---|---|---|
| 600747 | 7/1934 | Fed. Rep. of Germany | 242/85.1 |

*Primary Examiner*—John M. Jillions

*Attorney, Agent, or Firm*—Pitts and Brittian

[57] ABSTRACT

The holder for releasably storing flexible cord (10) and the like in a manner for dispensing in a tangle free condition. This holder has an elongated body member fabricated from a pair of substantially identical body portions (16, 18) pivotally connected at their junction (20). A releasable clasp (26) at this junction maintains the body portions in an aligned orientation during cord storage, or pivoted with respect to each other for completely dispensing the stored cord. A transverse passageway (24) positioned at this pivot point releasably grasps of the cord therein. Projecting substantially perpendicular from the body portions at opposite ends are a pair of handles (34, 36), and disposed from these handles toward the central juncture are a pair of posts (42, 44), one on each body portion, lying in the same plane as the handles and inclined away from each other. These posts provide for the storage of the cord in figure-8 loops. The outward ends of the posts are provided with hooks (46, 48) directed away from each other to assist in maintaining the cord on the posts during winding and storage. Because the cord is held at a mid-point in the body member, the cord can be withdrawn from the posts in a controlled and selectable manner as the unit will pivot about the passageway.

13 Claims, 5 Drawing Figures

TANGLE FREE CORD HOLDERcl DESCRIPTION

1. Technical Field

The present invention relates generally to devices for the winding and storage of ropes, electrical cords, and the like. More particularly, it relates to a device for winding, storing, and dispensing of various types of cords, including electrical cords, which prevents tangling and twisting of various loops of the cord upon removal from the storage device.

2. Background Art

There are many electrically operated devices which are to be operated at some distance from an electrical outlet. Typical of these are electrically operated chain saws, grass cutters, and the like. These necessitate the use of rather lengthly extension cords, frequently of the order of 100 feet or more. It is highly desirable that a user of one of these devices progress away from the point of electrical power without the length of cord becoming entangled upon itself. This is nearly impossible when the cord is stored in a normal fashion, such as in multiple loops created when the cord has previously been wound around the user's arm or typical storage type reels. The loops that are formed as the cord is removed from the storage device frequently encircle other loops and the cord becomes severely tangled. Also, the type of winding results in the cord having twists therein which substantially contribute to a tangling of the cord when deployed from a coiled condition.

In a similar manner, other types of cords of significant length are utilized in various applications as by riggers, water skiers and the like. Again, it is common practice to wind the tow rope up for a skier about a user's arm or some type of bobbin and the cord is thereby stored in oval loops. When the tow rope is to be cast out to a skier, these oval loops frequently become entangled, or the cord becomes twisted, necessitating a delay in getting the rope to the skier. For the rigger who often carries several hanks of rope or cord, any delay may be undesirable in deploying such ropes when they are needed.

These are but typical examples of the storage of ropes, cords, and the like, wherein it is desirable to prevent the tangling or twisting of the cord upon its deployment for use.

Several devices are described in the patent literature for the storage of flexible members such as a cord. One such device is shown and described in U.S. Pat. No. 2,590,695, issued to J. Gomberg on Mar. 25, 1952. The invention described therein relates to a holder or bobbin for knitting yarn. This particular device opens for the application of the yarn to the central bobbin and then closes to hold the same securely in place. There is no provision for quickly removing the entire amount of stored yarn and even if there were such, the yarn is stored in oval or circular loops which could easily become tangled if force is applied to an end of the yarn.

U.S. Pat. No. 3,901,458 issued to F. Kuncz, Jr., on Aug. 26, 1975 is designed principally for the storage of rope used in skiing tow lines, fishing lines, and the like. As in the above patent, material stored thereon is wrapped in oval loops such that there is potentially a high degree of the tangling or twisting of the line if completely removed from the so called rope caddy. In addition, there is a provision along one edge of the caddy to store the hand grips of a tow line and in the other edge to grasp a portion of the line to prevent accidental removal from the caddy.

In a like manner, a cord holder is described in U.S. Pat. No. 4,123,012 issued to W. Hough on Oct. 31, 1978. This is specifically shown as for the storage of an electrical cord. The cord is wound upon the device in oval loops and there is a provision for holding each end of the cord under hooks. There is no provision in this device for completely removing the cord except as by individually unwinding all loops from the cord holder.

The device shown in U.S. Pat. No. 4,261,529 issued to R. Sandberg on Apr. 14, 1981, provides an open type bobbin for the storage of ropes and the like. One end of the rope is permanently attached as by threading the same through several openings contained in the body, and the other end is temporarily secured to prevent unwinding in one of the appropriate slots in the ends of the body. The cord is wound about a pair of extending arms having hooks at their other end to keep the cord from accidentally slipping from the arms, and the arms are inclined outward and away from each other to facilitate the winding of the cord thereon. Although this device permits the winding of a cord in other than an oval loop, there is no showing or discussion of this capability. Furthermore, there is no way provided for a quick removal of all of the cord from the device; in fact, it must be unwound from the device loop by loop, if such is desired.

Still another type of rope caddy is that shown in U.S. Pat. No. 4,277,035, issued to J. Gaski on July 7, 1981. This device has an elongated body member with a pair of outwardly inclined arms which provide the supports upon which the cord can be wound. One or more of these arms can then be folded towards the other arm such that the entire stored cord can be dispensed. Although this device would provide for storage in other than an oval loop configuration, only a loop configuration is shown and described. There is no provision for removing cord from the holder in increments other than by unwinding each loop as in Sandberg.

Accordingly, it is a principal object of the present invention to provide a cord holder which permits the removal of the stored cord, either in its entirety or in selected amounts.

It is another object of the present invention to provide means to releasably grasp one end of the cord at a mid-point of the device in a manner such that as cord is drawn from the storage portion, through the application of longitudinal force, the device will pivot about the point at which the cord is grasped such that the cord will be drawn from the device in a controlled manner.

These and other objects of the present invention will become apparent upon consideration of the drawings identified below together with the following descriptive material.

DISCLOSURE OF THE INVENTION

In accordance with the present invention, a cord storage device or holder is provided which achieves either controlled removal of the cord therefrom in a tangle free manner or the complete and quick "dropping" of the cord may be achieved with the resultant cord being in an orientation such that it will be tangle or twist free upon deployment for its intended use. The holder is an open bobbin having outwardly extending arms upon which cord may be stored by winding in a figure-8 manner such that when the cord is completely removed from the holder in a quick fashion, the cord will be tangle free upon deployment. This quick release is provided by a hinged portion at the mid-point of the body such that the tips of the storage arms are moved closer to each other to accomplish the dropping of the entire cord stored thereon. In addition, the cord is releasably clamped at a mid-point of the holder such that when a controlled amount of cord is to be removed, it can be removed upon applying axial force to the free end of the cord while the holder pivots about the clamping position such that the cord is removed from one arm and then the other arm of the holder in a controlled manner. Thus, the cord can be plugged into a receptacle and then deployed for use.

BEST MODE FOR CARRYING OUT THE INVENTION

Figure 1:
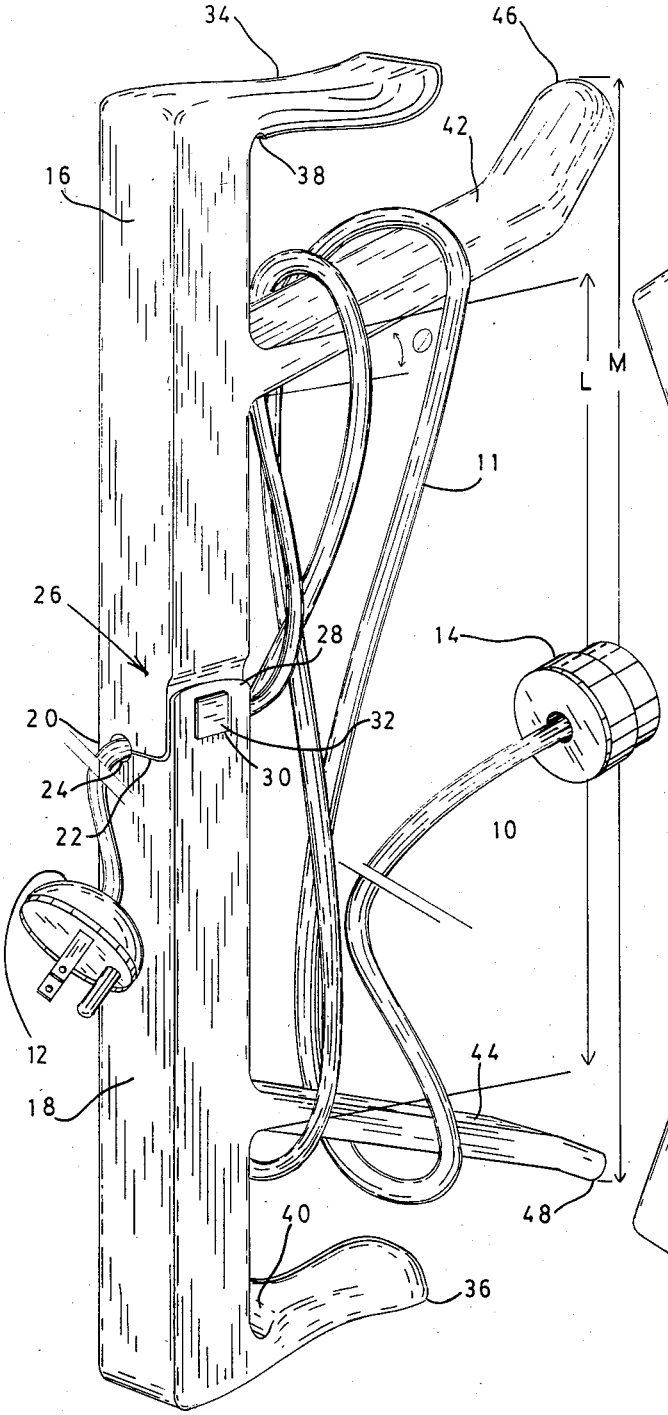
FIG. 1 is a perspective drawing of a cord holder of the present invention.

Referring now to FIG. 1, shown therein is one embodiment of the present invention in a perspective view. This is illustrated for the storage of an electrical cord 10 having a plug unit 12 at one end and a socket unit 14 at the opposite end. Although only two figure-8 type loops 11 of the cord 10 are shown, it will be recognized that a relatively large number of loops can be stored upon the present invention. The unit is provided with a pair of body portions 16 and 18 that are substantially identical and of equal length. They are joined at the mid-point of the body unit with an intregal web 20 (or other suitable hinge) with the remaining tranverse cross-section of the body having a parting line 22 terminating in a substantially cylindrical passageway 24 adjacent the aforementioned web 20. A fastener unit 26 is provided at substantially the mid-point of the body unit, which fastener maintains the two body portions 16 and 18 in aligned orientation as shown. This fastener unit 26 includes a clasp 28 projecting from the body portion 18 toward the body portion 16, with this clasp 28 being provided with an aperture 30 therein. Projecting outwardly from the other body portion 16 is a button 32 which frictionally engages the aforementioned aperture 30 to keep the fastening unit 26 in a closed position as shown.

Each of the body portions 16 and 18 is provided with a handle 34, 36, respectively, which projects substantially perpendicular from the body unit in a common plan. The oppositely directed surfaces of these handles can be slightly curved for purposes to be described hereinafter. The handles are each provided with a notch 38, 40 near the junction to the body such that the device may be hung from an appropriate hook or other device for storage thereof.

Spaced inwardly from the handles, i.e. toward the center of the body made up of body portions 16 and 18, are a pair of posts 42, 44, extending outwardly in the same plane as the handles 34 and 36. These posts are oriented at a slight angle from the perpendicular, this angle being indicated as theta, such that they diverge from each other as they proceed away from the body portions. The outward ends of these posts are provided with oppositely directed hooks 46, 48, respectively, to assist in the normal storage of the cord 10 thereon. In this figure is shown a dimension L which is the minimum of the normal spacing between the oppositely directed surfaces of the posts 42 and 44, and the dimension M which is the maximum dimension between the hook 46 and the hook 48.

Figure 2:
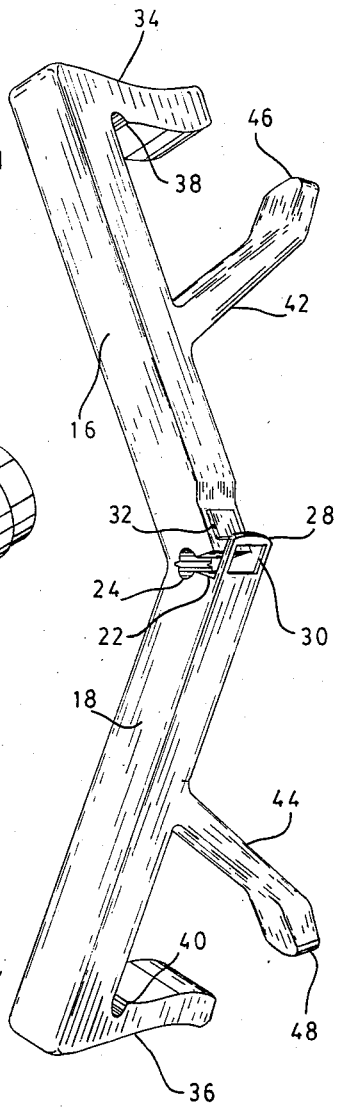
FIG. 2 is a drawing of the embodiment shown in FIG. 1 illustrating the hinged action between the two portions of the body.

This same embodiment of the present invention is illustrated in FIG. 2 showing the clasp 28 disengaged from the button 32. In this condition, the body portions 16 and 18 can be moved to a non-axially oriented position by bending the unit at the aforementioned web 20. When in this position, the cord 10 may be passed through the passageway 24 to be positioned as is shown in FIG. 1, or disengaged from the passageway. In addition, as will be explained in connection with FIG. 3, any cord stored around the posts 42, 44, can be simultaneously dispensed from the holder in a tangle free manner.

Figure 3:
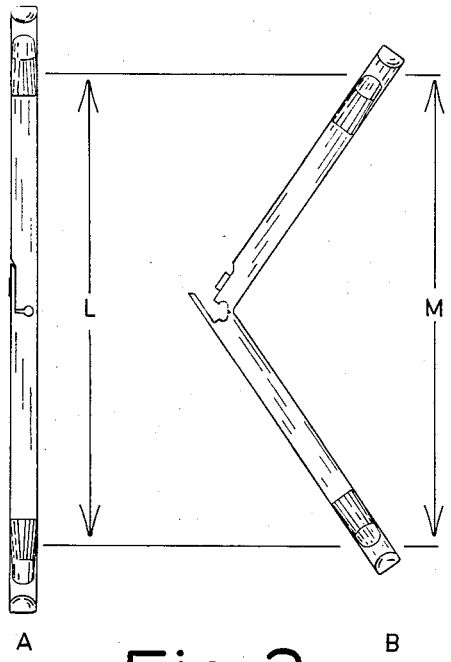
FIG. 3 is a drawing illustrating how the holder is permitted to drop a complete cord upon bending at a mid-point.

Referring to FIG. 3, the view shown in A is an edge view of the embodiment of FIGS. 1 and 2 as viewed along the plane of the handles and posts with the fastener unit in the latched position. As above, the dimension L is that between the outwardly directed surfaces of the posts 42, 44, when in this fully extended position. In view B, the fastener has been unlatched, allowing the two body portions to be bent as shown in FIG. 2. When the dimension M, which is the dimension between the outwardly directed hooks, becomes equal to or less than the original value of the dimension L, the body unit can be orienated horizontally and the entire stored cord dropped as one unit from this embodiment. Since the cord has been wound in a figure-8 fashion, the cord can be drawn from the pile of loops without becoming entangled upon other loops.

Figure 4:
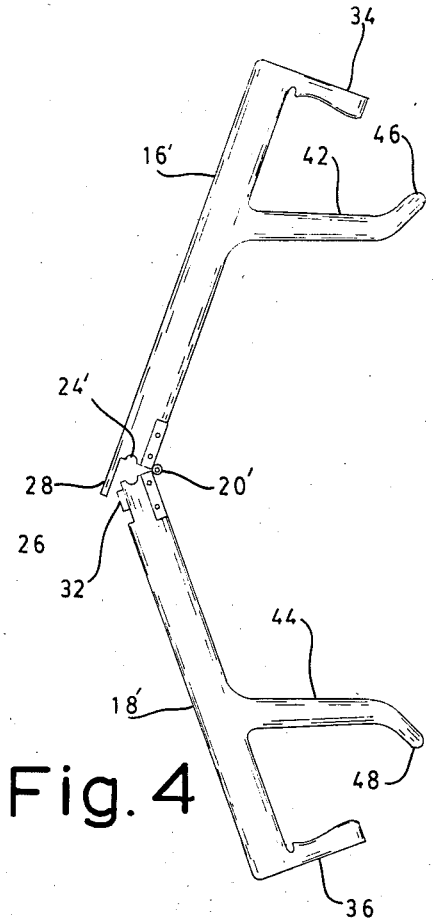
FIG. 4 is a side view of another embodiment of the present invention showing a hinged member at the mid-point which permits the bending in a different plane than that of the embodiment of FIGS. 1 and 2.

Another embodiment of the present invention is shown in FIG. 4. This embodiment operates in a similar fashion and has most of the same features as shown in FIGS. 1 and 2. Components which are identical with those of the prior embodiment are identified with the same numerals, and corresponding but slightly changed components are identified with a prime following the numerals. In this embodiment, body portions 16'and 18' are joined with a hinge 20' which alternatively can be a web portion orientated at ninety degrees from the web portion of FIGS. 1 and 2. Oppositely disposed from the hinge 20' is a fastener 26 having components 28 and 32 for fastening or unlatching the hinge 20'. In a like manner, this embodiment has a passageway 24' orientated at a mid-point of the entire device but at ninety degrees from the passageway shown in FIGS. 1 and 2. This embodiment provides for the storage of cord as wound in a figure-8 manner such that when the body portions 16' and 18' are folded toward each other, the hooks 46 and 48 move toward each other such that all of the cord stored in a figure-8 fashion upon the holder can be dropped from the holder in a tangle free condition such that it can be deployed by applying axial force to the end of the cord. It will be understood that the embodiments of FIGS. 1 or 4 can include a clip or other element (not shown) with which to releasably retain the free end of a cord when wound upon the holder.

Figure 5:
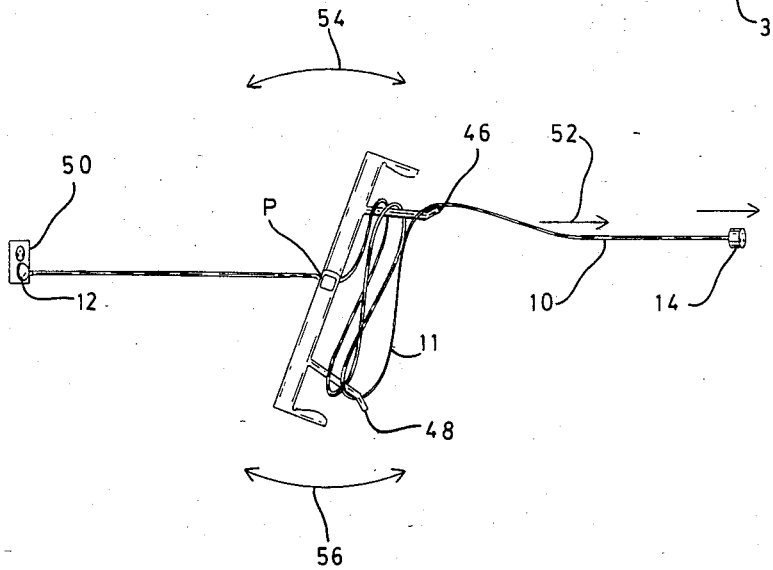
FIG. 5 is a drawing illustrating how the present invention permits the removal of a selected portion of the cord stored thereon, through pivoting action, upon an axial pull being applied to the cord.

Illustrated in FIG. 5 is the manner in which a selected portion of the cord 10 can be removed from the embodiment shown in FIGS. 1 and 2. It is equally applicable to the removal of selected portions of the cord in the embodiment illustrated in FIG. 4. Shown in this figure is the electrical plug 12 engaged in a conventional electrical outlet receptical 50. Preferrably, the cord should be releasably attached to some structure near the plug such that axial pull upon the cord does not disengage the plug 12 from the receptical 50. When it is desired to remove a selected amount of cord from the unit, axial pull upon the cord at the socket 14 moves the cord 10 in a direction indicated by the arrow 52. Since the cord 10 is clamped in passageway 24 at a mid-point of the unit, this mid-point becomes a pivot P such that the unit pivots or oscillate's about this point as indicated with the arrows 54 and 56. Thus, the cord is first disengaged from the hook 46 and then, upon further pull, from the hook 48. This is continued until the desired quantity of cord 10 has been removed for a specific utilization thereof.

It will be understood that in either of these embodiments, the cord is placed upon the unit by first clamping a portion near one end, e.g., the plug 12, thereof in the passageway 24. Thereafter, the remaining cord is wound in a figure-8 fashion over the posts 42 and 44 until all of the cord has been wound upon the device. Because of the slope of the posts 42 and 44, the figure-8 loops can be periodically moved toward the body portions 16 and 18 to accommodate further winding of the cord thereon. During this winding, particularly when the cord is of heavy duty, the aforementioned curved surfaces of the handles 34 and 36 permit the same to be held against a person doing the winding (as against a leg or waist) to brace the same while the opposite handle is held in one hand. The device can also be held against the ground or another object. The user's other hand is then free to wind the cord in the aforementioned figure-8 manner about the posts 42 and 44.

From the foregoing, it will be seen by those versed in the art that an improved cord holder has been shown and described for the storage of any type of flexible cord and then the dispensing thereof in a tangle and twist free manner. This dispensing can be of a selected length of cord or the entire amount of cord stored on the holder. This is particularly accomplished by the clamping at the midpoint together with the bending or folding at the midpoint.

It is, of course, understood that although perferred embodiments of the present invention have been illustrated and described, various modifications thereof will become apparent to those skilled in the art. Accordingly, the scope of the invention should only be defined by the appended claims and the equivalents thereof.

I claim:

1. A holder for the winding and storing of flexible cord thereon, such holder permitting the removel of such cord in selected amounts or in its entirety in tangle free condition, which comprises:

an elongated body member having first and further substantially identical body portions each having a first and a further end;

a hinge member joining each of said first ends of said body portions to form said body member;

a clasp at said hinge member to releasably immobilize said hinge member when said body portions are aligned;

means proximate said hinge member for releasably grasping such cord at a midpoint of said body member when said first and further body members are aligned and releasing such cord when said body portions are not aligned;

A first post member having a first end joined to said first body portion at a location removed from said hinge member, and having a further end;

a further post member having a first end joined to said further body member at a location symmetrical and in a common plane with said first post member, and having a further end; and wherein said further ends of said post members are separated a greater distance than said first ends of said post members when said first and further body portions are aligned.

2. The holder of claim 1 wherein:

said further ends of said post members each include a hook element directed away from said hinge member.

3. The holder of claim 1 further comprising:

a first handle having a first end attached at said further end of said first body portion at a location more removed from said hinge member than said first post member, said first handle projecting substantially perpendicular from said first body portion in said common plane of said post members; and a further handle having a first end attached at said further end of said further body portion at a location more removed from said hinge member than said further post member, said further handle projecting substantially perpendicular from said further body portion in said common plane of said post members.

4. The holder of claim 1 wherein each of said first ends of said body portions of said body member is provided with a hemi-cylindrical groove which, when combined when said body portions are aligned by said clasp, provide for a cylindrical passageway at said midpoint of said body member to provide said means for releasably grasping such cord.

5. The holder of claim 3 wherein each of said first and further handles is provided with a transverse notch in an edge facing said post members proximate said first end of each of said handles.

6. A holder for the winding and storing of flexible cord thereon, such holder permitting the removal of such cord in selected amounts or in its entirety in a tangle free condition, which comprises:

an elongated body member having first and further substantially identical body portions each having a first and a further end, each of said first ends being provided with a hemi-cylindrical groove which, when combined, provides for a transverse cylindrical passageway through said body member at a midpoint thereof;

a hinge member joining each of said first ends of said body portions;

a clasp at said hinge member to releasably immobilize said hinge member;

a handle member projecting substantially perpendicularly from each of said body portions at said further ends thereof; and a post member projecting from each of said body portions in a common plane with said handle members, each of said post members having a first end symmetrically joined to said body portions intermediate said handle member and said hinge member, with said further end of each of said post members being formed into a hook oppositely directed from each other, said post members diverging equally outwardly from said body members at a selected angle.

7. The holder of claim 6 wherein said hinge member is an integral web joining said first ends of said body portions, and said passageway has an axis substantially in said plane of said handles and said post members, said web providing for pivoting said first body portion with respect to said further body portion in a direction perpendicular to said plane.

8. The holder of claim 6 wherein said clasp comprises a latch provided with an aperture therethrough attached to said first end of said first body portion and extending toward said first end of said further body portion, and a button extending from said first end of said further body portion for frictional engagement with said aperture in said latch.

9. The holder of claim 6 wherein said hinge member and said passageway are perpendicular to said plane of said handles and post member whereby said first body portion can be pivoted with respect to said further body portion in said plane.

10. The holder of claim 6 wherein each of said handles has a first end attached to said body portion and a cantilivered further end, and each handle is provided with a notch in a surface toward said post members to accept a fixed support member for hanging such holder on said support member.

11. The holder of claim 6 wherein each of said handles is provided with a substantially arcuate surface directed oppositely from each other to provide a resting surface for placement against an object during winding of such cord upon such holder.

12. A holder for the winding and storing of flexible cord thereon, such holder permitting the removal of such cord in selected amounts or in its entirety in a tangle free condition, which comprises:

an elongated body member having first and further substantially identical body portions each having a first and a further end, each of said first ends being provided with a hemi-cylindrical groove which, when combined, provides for a transverse cylindrical passageway through said body member at a midpoint thereof;

a hinge member joining each of said first ends of said body portions, said hinge member being an integral web formed between said first ends of said body portions;

a clasp at said hinge member to releasably immobilize said hinge member, said clasp including a latch provided with an aperture therethrough attached to said first end of said first body portion and extending toward said first end of said further body portion, and a button extending from said first end of said further body portion for frictional engagement with said aperture;

handle members each having a first and a further end projecting in a common plane and substantially perpendicularly from each of said body portions at said further ends thereof, each of said first ends of said handles joined to said body portions, each of said handles being provided with a transverse notch near said first ends of said handles, said notch being in facing edges of said handles; and a post member projecting from each of said body portions in said common plane with said handle members, each of said post members having a first end symmetrically joined to said body portions intermediate said handle member and said hinge member, and a further end being formed into a hook oppositely directed from each other, said post members diverging equally outwardly from said body members at a selected angle.

13. A holder for winding and storing of flexible cord thereon, such holder permitting the removal of such cord in selected amounts or in its entirety in a tangle free condition, which comprises:

an elongated body member having first and further substantially identical body portions, each having a first and a further end;

a hinge member joining each of said first ends of said body portions to form said body member;

a clasp at said hinge member to releasably immobilize said hinge member when said body portions are aligned;

means proximate said hinge member for releasably grasping such cord at a midpoint of said body member, said means comprising providing in each of said first ends of said body portions a semi-cylindrical groove which, when combined when said body portions are aligned by said clasp, provide a cylindrical passageway at said midpoint of said body member to releasably grasp such cord;

a first post member having a first end joined to said first body portion at a location removed from said hinge member, and having a further end;

a further post member having a first end joined to said further body member at a location symmetrical and in a common plane with said first post member, and having a further end; and wherein said further ends of said post members are separated a greater distance than said first ends of said post members.

* * * * *